United States Patent [19]

Stoffel et al.

[11] Patent Number: 4,527,412

[45] Date of Patent: Jul. 9, 1985

[54] METHOD FOR MAKING A NECKED CONTAINER

[75] Inventors: Hans F. Stoffel, Rye, N.Y.; William T. Saunders, Weirton, W. Va.; Anthony J. Sporri, Tallapoosa, Ga.

[73] Assignee: Stoffel Technologies, Inc., Tuckahoe, N.Y.

[21] Appl. No.: 479,190

[22] Filed: Mar. 28, 1983

[51] Int. Cl.[3] ..... B21B 22/00

[52] U.S. Cl. ..... 72/349; 493/1; 493/69

[58] Field of Search ..... 72/347, 348, 349, 352, 72/354; 493/1, 69

[56] References Cited

U.S. PATENT DOCUMENTS

| | | | |
|---|---|---|---|
| 1,698,999 | 1/1929 | Hothersall . | |
| 2,789,344 | 4/1957 | Kaul . | |
| 3,203,213 | 8/1965 | Grotnes . | |
| 3,581,542 | 6/1971 | Wahler . | |
| 3,688,538 | 9/1972 | Hayne | 413/69 |
| 3,763,807 | 10/1973 | Hilgenbrink . | |
| 3,765,351 | 10/1973 | Kubacki . | |
| 3,782,314 | 1/1974 | Franek | 413/1 |
| 3,786,957 | 4/1957 | Hilgenbrink | 220/72 |
| 3,964,413 | 6/1976 | Saunders . | |
| 3,995,572 | 12/1976 | Saunders | 72/348 |
| 4,070,888 | 1/1978 | Gombas . | |
| 4,261,193 | 4/1981 | Boik . | |
| 4,303,032 | 12/1981 | Takahashi | 413/1 |
| 4,320,848 | 3/1982 | Dye . | |
| 4,392,764 | 7/1983 | Kubis | 413/69 |
| 4,403,493 | 9/1983 | Atkinson | 72/354 |

FOREIGN PATENT DOCUMENTS

| | | |
|---|---|---|
| 0020926 | 7/1981 | European Pat. Off. . |

*Primary Examiner*—Leon Gilden

*Attorney, Agent, or Firm*—Antonelli, Terry & Wands

[57] ABSTRACT

A method and apparatus for making a necked container are disclosed wherein a sheet material is formed into a generally cylindrical tubular member and the adjacent longitudinally extending edges of the sheet are butt welded. The welded tubular member is progressively necked-in over a dome-shaped surface of a single mandrel provided within the welded tubular member. The free end of the necked end portion of the tubular member is trimmed and curled to form a necked container body.

14 Claims, 10 Drawing Figures

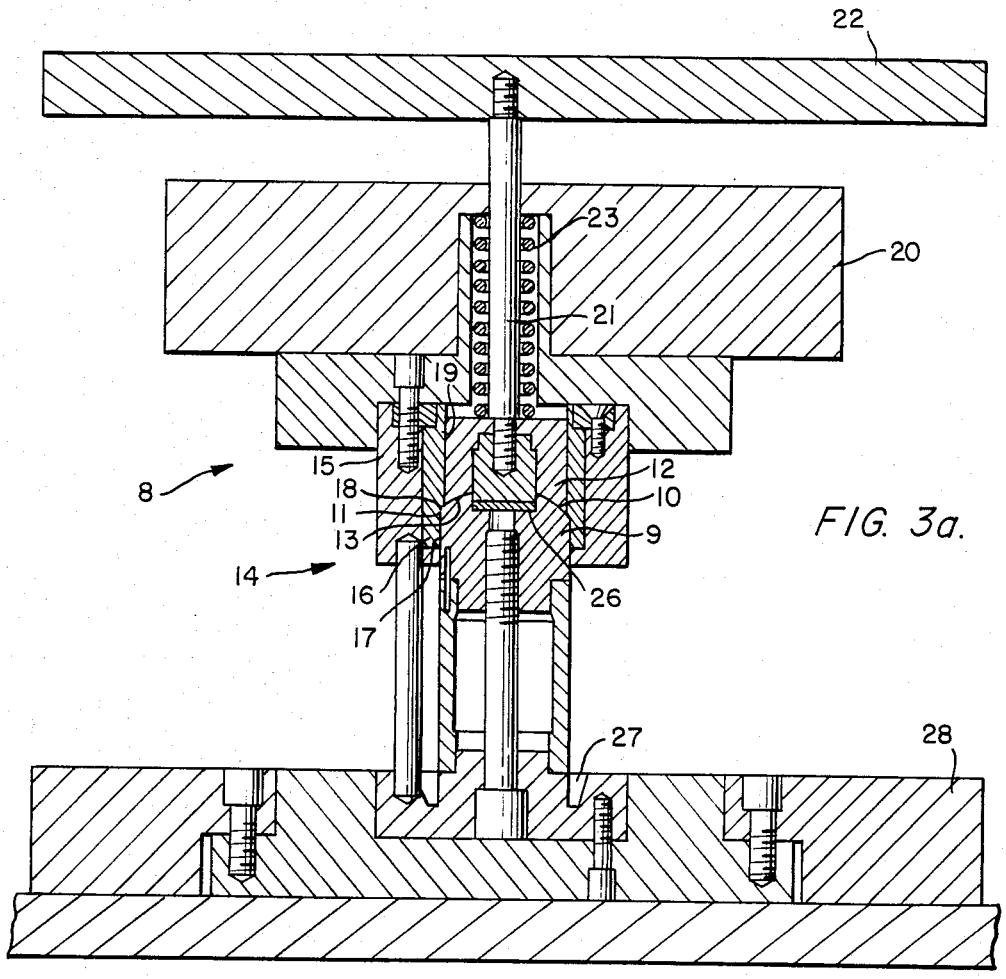
FIG. 3a.
FIG. 4a.
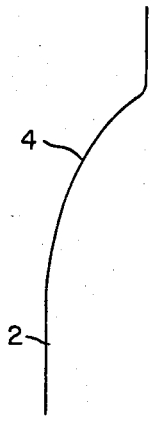
FIG. 4b.
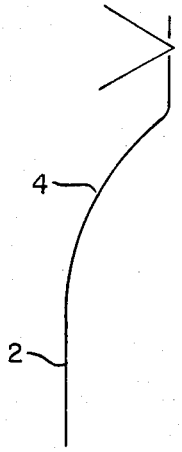
FIG. 4c.
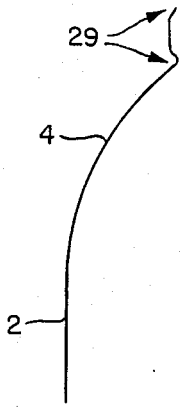
FIG. 4d.
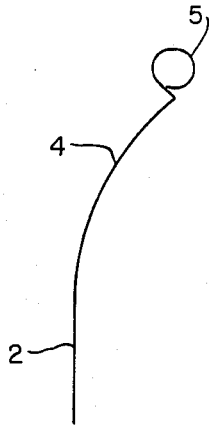

METHOD FOR MAKING A NECKED CONTAINER

BACKGROUND AND SUMMARY OF THE INVENTION

The present invention relates to an improved method and apparatus for making a necked container and to the necked container formed thereby. More particularly, the invention relates to an improved method and apparatus for making a necked container wherein one end of the container is necked-in at least 15% from the original container diameter so as to be useful as an aerosol can, for example.

In the past there have generally been two basic kinds of necked aerosol containers: those made of steel sheet material such as tin plate, and those made of aluminum. In the case of steel sheet material, one form of construction for the aerosol containers has been the three-piece container having a cylindrical container body with a longitudinally extending soldered or welded lap joint and with a dome-shaped top and a bottom seamed thereon. Steel sheet material aerosol containers have also been formed out of flat steel sheet by a method called drawn and ironed. On such cans a dome-shaped top is mounted to form a two-piece container. Another drawn and ironed technique involves forming a steel cup, cutting a hole in the cup and curling the adjacent edge to form a necked top and then seaming a bottom to the cup.

Necked aerosol containers of aluminum may be made by a method which involves forming so-called monoblocs from an aluminum slug into a cup. The top of the cup is formed with a relatively small opening and an outside curl on which an aerosol valve is mounted. A drawn and ironed process may also be used to form aluminum aerosol containers from flat sheets of aluminum. A two-piece aluminum can formed by such a method has a dome-shaped top which is mounted the same way as on a tinplate three-piece container. Aluminum aerosol containers may also be integrally formed with a top having a relatively small opening for an aerosol valve and with the bottom of the container being seamed on to form a two-piece container.

Thus, it is known to make necked aerosol containers either by providing a cylindrical container body with a special end or by shaping the end of a container particularly when the container is formed of readily workable metal, such as aluminum. However, until recently the forming of a dome from a steel can body has been impractical from a commercial standpoint.

It is known to reduce the diameter of an end portion of a can body by a series of necking-in operations. However, in such bodies in lieu of the conventional smooth dome appearance there has generally been either a series of steps or a very wrinkled appearance.

U.S. Pat. No. 4,261,193 discloses a method and apparatus for making a necked steel aerosol container having an integral dome wherein the container is formed by welding the overlapping longitudinally extending edges of a steel sheet which has been formed into a cylindrical can body and thereafter progressively necking-in the welded can body. In this known process the overlapped edges of the cylindrical container body are welded together by a conventional welding process such as electrical resistance welding. With such a welded cylindrical can body the wall thickness of the can body is greater at the welded side seam than it is elsewhere about the circumference of the can body. Thus, necking of this known type of cylindrical container body is problematical in that it is not commercially feasible to orient the lap weld side seam with the tooling during the necking operations and therefore in the apparatus disclosed in the aforesaid patent, it is necessary that the outside tools be permitted to float radially in order to maintain the required clearance at all circumferential points between the tools of each set of tooling. The greater thickness of the lap weld side seam may also adversely affect the appearance of the necked container in that the uneven or discontinuous nature of the weld and subsequent wrinkles from forming may be readily visible by the casual observer. The method and apparatus for making a necked container disclosed in the aforesaid patent are also disadvantageous in that they require a complete assembly and disassembly of the lap welded can body with respect to each of a plurality of sets of necking tools. Thus, either the can body or entire sets of tools must be transferred from station-to-station during the necking-in steps which can be a relatively slow process subject to damaging either the cans or the tools.

An object of the present invention is to provide an improved method and apparatus for making a necked aerosol container for an aerosol can, for example, which avoid the aforementioned disadvantages of the prior art. More particularly, an object of the invention is to provide an improved method and apparatus for making a necked container which may be formed from welded sheet material thereby providing a container which is relatively low in cost as compared with the prior containers such as the aluminum monobloc container.

A further object of the invention is to provide an improved method and apparatus for making a necked container having an integral dome wherein the container is formed from a cylindrical can body having a longitudinal side seam and wherein the dome is formed by a progressive necking-in process such that the dome-shaped configuration is smooth instead of being provided with a series of steps or a wrinkled appearance.

An additional object of the present invention is to provide an improved method and apparatus for making a necked container such that it is possible to progressively neck-in the end of a welded steel cylindrical can body without getting a wrinkle or an S-curve during necking and without necessitating the use of sets of tooling that float radially and that must be completely exchanged with each successive necking-in step.

These and other objects of the present invention are attained by providing a method of making a necked tubular member comprising the steps of forming a sheet of material into a generally cylindrical tubular member and butt welding the adjacent longitudinal extending edges of the sheet, arranging the butt welded tubular member about a mandrel having a free end portion with a dome-shaped surface, reducing the diameter of a free end portion of the tubular member and forming an intermediate portion between the the reduced diameter free end portion and the remainder of the tubular member which extends along a portion of the dome-shaped surface of the mandrel, and further reducing the diameter of the free end portion of the tubular member and increasing the extent of the intermediate portion along the dome-shaped surface of the mandrel.

The step of further reducing the diameter of the free end portion of the tubular member and increasing the extent of the intermediate portion along the dome-shaped surface of the mandrel is repeated until the diameter of the free end is reduced at least approximately 15% from the original diameter of the tubular member and, according to a disclosed embodiment, until the diameter of the free end is on the order of one-half of the original diameter. The diameter of the free end portion of the tubular member is reduced approximately 7 to 8% in each of the initial reducing steps and 3 to 4% in the final steps to reach a final diameter which is on the order of one-half of the original diameter.

The method of the invention includes the additional step of trimming the reduced free end portion of the tubular member and curling it. In one form of the invention the free end portion of the tubular member is curled by first beading the free end portion inwardly and then curling it inwardly on itself so that the trimmed edge thereof is tucked inside the curl.

An apparatus of the invention for progressively necking-in an end portion of the butt welded tubular member comprises a first inside tool of a first diameter, a free end portion of said inside tool having a dome-shaped surface, a plurality of second inside tools each having a second diameter which is less than the first diameter of the first inside tool and having a free end portion for positioning adjacent the dome-shaped surface of the first inside tool with the dome-shaped surface extending between the first diameter of the first inside tool and the second diameter of the second inside tool, the second diameter of the second inside tools progressively decreasing so that the extent of the dome-shaped surface between the first and second diameter progressively increases, and a plurality of outside tools cooperable with the first inside tool and respective ones of the second inside tools.

In a disclosed embodiment of the apparatus, each of the plurality of outside tools have an internal configuration with a first portion cooperable with the first diameter of the first inside tool, a second portion cooperable with the dome-shaped surface extending between the first diameter of the first inside tool and second diameters of one of the second inside tools and a third portion cooperable with the second diameter of one of the second inside tools. In the disclosed embodiment, the second diameter of the second inside tools progressively decreases to a diameter on the order of one-half of the first diameter.

Means are provided for moving one of the first inside tool and a cooperable pair of a second inside tool and an outside tool with respect to the other for effecting necking-in of the end portion of the tubular member. In the illustrated embodiment, the means for moving comprises a press ram which moves the cooperable pair with respect to the first inside tool in a direction along the longitudinal axis of a tubular member to be necked-in which is located about the first inside tool.

According to a further feature of the invention, means are provided for mounting the second inside tool of the cooperable pair in a leading and relatively movable position with respect to the outside tool so that with relative movement of the cooperable pair with respect to the first inside tool, the second inside tool reaches a position adjacent the dome-shaped surface of the first inside tool while the outside tool continues to move with respect to both the first and second inside tools for effecting necking-in of the end portion of the tubular member. The means for mounting the second inside tool of the cooperable pair in a leading and relatively movable position with respect to the outside tool includes a spring for yieldably biasing the second inside tool in the leading position.

As an additional feature of the invention, the second inside tool of the cooperable pair includes an abutment member located centrally in its free end portion for contacting a portion of the first inside tool when the second inside tool is positioned adjacent the dome-shaped surface. A recess is provided in the center of the free end portion of the first inside tool for receiving the abutment member when the second inside tool is positioned adjacent the dome-shaped surface. A spacer is located in the recess for contacting the abutment member to control the relative positions of the first and second inside tools.

With the method and apparatus of the invention, it is possible to progressively neck-in a free end portion of the butt welded tubular member to form a dome-shaped surface without the use of outside tools which float radially and without getting wrinkles or an S-curve during necking-in. This necking-in process is facilitated by the fact that the thickness of the butt weld in the can body is the same or essentially the same as the wall thickness of the can body outside the weld area, and by the relatively small weld heat-affected zone and minimal degradation of base material properties associated therewith which result from welding with a high energy density welding process such as laser welding or electron beam welding wherein the energy density is at least $10^6$ per square inch.

The necked container body of the invention comprises a welded tubular member having a butt welded joint extending longitudinally thereof, one end of the welded tubular member being necked-in to a diameter which is reduced by at least approximately 15% from the original diameter of the tubular member with the necked-in end of the tubular member having a dome-shaped configuration. In the disclosed embodiment one end of the tubular member is necked-in to a diameter which is reduced on the order of one-half of the original diameter of the tubular member and the free end of the necked end is curled inwardly on itself with the edge of the free end being tucked inside the curl.

These and other objects, features and advantages of the present invention will become more apparent from the following description when taken in connection with the accompanying drawings which show, for purposes of illustration only, several embodiments in accordance with the invention.

BRIEF DESCRIPTION OF THE DRAWINGS

FIG. 2 is a sectional view taken through the portion of the upper, necked end of a butt welded tubular member which has been necked-in to form an aerosol container as shown in FIG. 1 and wherein the tubular member is shown in the various positions as it is progressively necked-in;

FIG. 3*a* is a sectional view of the apparatus of FIG. 3 but with the press ram in its lower position;

FIG. 4*a* is a schematic illustration of one side of the upper portion of a tubular member which has been necked-in to form an aerosol container as shown in FIG. 1;

FIG. 4*b* is a schematic illustration similar to FIG. 4*a* and graphically illustrating trimming of the free end of the upper necked-in portion of the tubular member;

FIG. 4*c* is a schematic illustration similar to FIG. 4*b* and illustrating the trimmed tubular member after the necked-in portion has been beaded inwardly;

FIG. 4*d* is a schematic illustration similar to FIG. 4*c* and wherein the upper end of the necked-in tubular member is curled inwardly.

DETAILED DESCRIPTION OF THE DISCLOSED EMBODIMENTS

Figure 1:
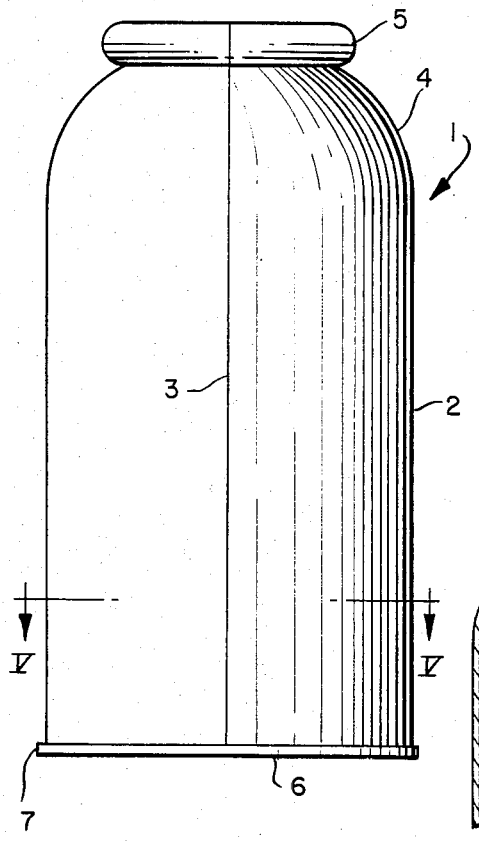
FIG. 1 is a side elevational view of one embodiment of an aerosol container made with the method and the apparatus of the invention.

Referring now to the drawings, it will be seen that there is illustrated in FIG. 1 a necked container 1 suitable for use as an aerosol can. The container 1 has an appearance like that of an aluminum aerosol can produced from the so-called monoblocs or by a drawn and ironed process but differs therefrom in that the can body 2 is made by the method of the invention wherein a sheet of material is formed into a generally cylindrical tubular member and the adjacent longitudinally extending edges thereof are butt welded to form the side seam 3 and thereafter the welded tubular member is arranged about a mandrel and an end portion thereof progressively necked-in over a dome-shaped surface of the mandrel as discussed more fully below. The upper, necked-in end of the welded tubular body 2 is necked-in to a diameter which is reduced by at least approximately 15% from the original diameter of the tubular member and, more particularly, in the disclosed embodiment, is reduced to a diameter on the order of one-half of the diameter of the tubular member, with the necked-in end having a smooth dome-shaped configuration. The upper free end of the necked-in welded tubular member is curled as shown at 5 for recieving a conventional arosol valve assembly (not shown) which may be secured to the upper end of the tubular member by a conventional seam.

As illustrated in FIG. 1, the container body 2 is cylindrical over a major portion of its height with the lower end thereof being closed by a conventional end unit 6 secured to the body 2 by means of a conventional seam 7. The sheet material used to form the can body 2 is a plain low carbon steel sheet metal such as a single reduced, T-4CA, 75 lb. per base box material having a thickness of 0.0083 inch. A double reduced material, such as DR-9, could also be used where a higher tensile strength is desired. Flat blanks of this sheet material are formed into a generally cylindrical configuration with the opposed longitudinally extending edges in abutting relationship for laser butt welding by a Z-bar guide apparatus as disclosed in U.S. Pat. Nos. 4,272,004 and 4,354,090. These apparatus have only recently made possible the successive, high-speed laser butt welding of the longitudinally extending edges of tubular members.

Figure 3B:
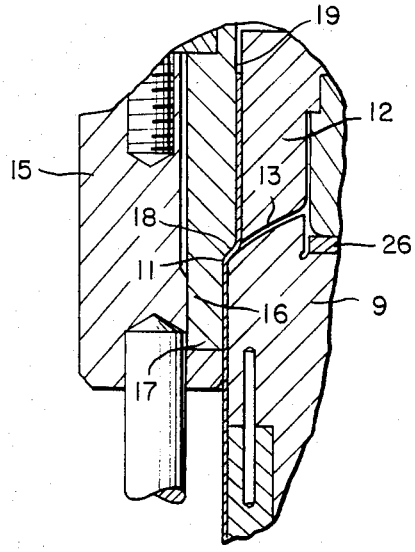
FIG. 3*b* is a sectional view of a portion of the apparatus as shown in FIG. 3*a* and illustrating a portion of the end of a tubular member being necked by the apparatus.
Figure 3:
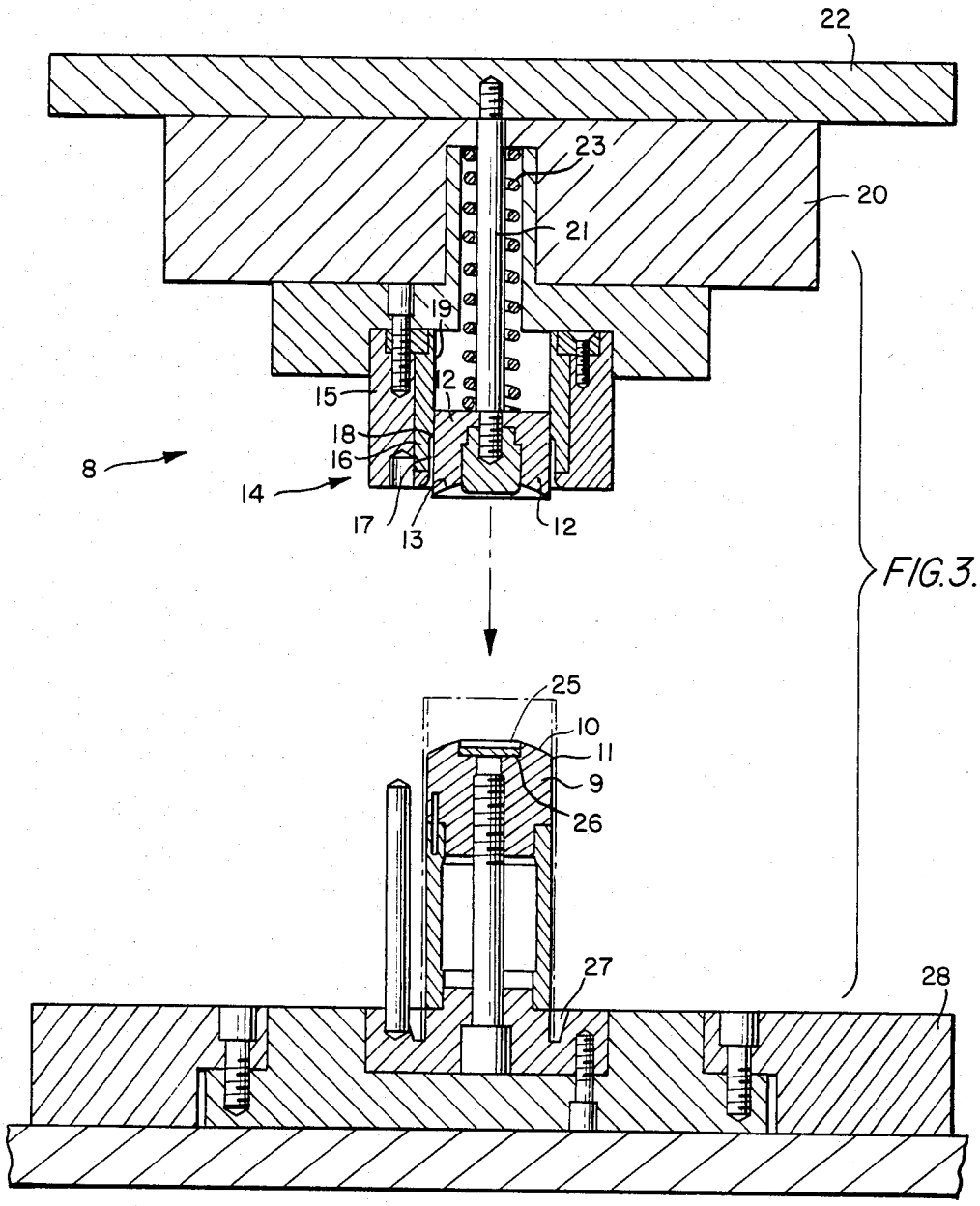
FIG. 3 is a sectional view of one embodiment of an apparatus of the invention for making the aerosol container shown in FIG. 1 and wherein the press ram is shown in its upper position.

An apparatus of the invention for progressively necking-in an end portion of a butt welded tubular member is generally designated as 8 in FIG. 3. The apparatus comprises a first inside tool in the form of a stationary cylindrical supporting mandrel 9 of a first diameter. The upper, free end portion of the mandrel has a smooth dome-shaped surface 10 with a radius of curvature of 1.5 inches in the case of necking a welded tubular member 2.080 inches in diameter. The juncture 11 between the dome-shaped surface 10 and the cylindrical side wall portion of the mandrel 9 is provided with a radius of curvature of0.125 inch. The apparatus 8 further includes a plurality of second inside tools or knockout plugs 12 each having a second diameter which is less than the first diameter of the mandrel 9 and having a lower, free end portion 13 for positioning adjacent the dome-shaped surface 10 of mandrel 9 with the dome-shaped surface extending between the outer diameter of the mandrel 9 and the diameter of the knockout plug 12. The shape of the knockout plug 12 is changed with each progressive diameter change or necking-in step as discussed below. In particular, the outer diameter of the cylindrical knockout plugs 12 progressively decrease with each necking-in step so that the extent of the dome-shaped surface between the outer diameter of the mandrel 9 and the knockout plug progressively increases.

The apparatus 8 further includes a plurality of outside tools generally designated at 14 cooperable with the mandrel 9 and respective ones of the knockout plugs 12 during necking-in of the end portion of a tubular member. While only one of the outside tools 14 and cooperating knockout plug 12 are shown in the drawings, it is understood that the apparatus comprises a plurality of sets or pairs of these tools which may be mounted about a circle on a turret, for example, or in a straight line on a suitable press as discussed hereinafter for successive use as will be readily apparent to the skilled artisan. However, since a single mandrel 9 is used with each necking-in step, it is not necessary to remove the tubular member from about the mandrel during the various steps of the process. The necking-in of the tubular member can thus be accomplished in a simpler and faster manner subject to less damage as compared with the prior art and without requiring mounting of the outside tools so as to float radially.

Each outside tool 14 includes a die piece 15 and a die insert 16 whose size or shape changes with each progressive diameter change or necking-in step. Each of the plurality of outside tools 14 have an internal configuration with a first cylindrical portion cooperable with the outer diameter of the cylindrical mandrel 9, a second inwardly tapered portion 18 cooperable with the dome-shaped surface 10 extending between the outer diameter of the mandrel 9 and the outer diameter of the adjacent knockout plug 12, and a third portion in the form of a cylindrical surface cooperable with the outer diameter of one of the knockout plugs 12.

As depicted in FIG. 3, an outside tool 14 and a cooperable knockout plug 12 are mounted on a press ram 20 of a standard 35 ton straight side punch press for movement with respect to the stationary mandrel 9. The knockout plug 12 of the cooperable pair is normally biased in a leading and relatively movable position with respect to its associated outside tool 14 as illustrated in the upper righthand portion of FIG. 3. With downward movement of the press ram 20, the knockout plug 12 reaches a position adjacent the dome-shaped surface 10 of the mandrel 9 while the outside tool 14 continues to move with respect to both the knockout plug 12 and the mandrel 9 for effecting necking-in of the end portion of the tubular member. In particular, the knockout plug 12 is carried at the lower end of a knockout bolt 21 which extends through the press ram 20 and operates off a knockout bar 22 above the press ram. A spring 23 yieldably biases the knockout plug in this leading position as shown in FIG. 3.

The knockout plug 12 has a central recess in its lower end which accommodates an adjusting abutment member 24 for contacting a portion of the mandrel 9 when the knockout plug is positioned adjacent the dome-shaped surface 10 thereof. The lower end of the adjusting abutment member 24 is received in a central recess 25 in the upper end of the mandrel 9. A spacer or shim 26 is located in the recess for contacting the abutment member 24 to control the relative positions of the mandrel 9 and knockout plug 12.

A butt welded tubular member is necked-in at one end with the apparatus 8 by arranging the welded cylindrical tubular member about the mandrel 9 with a free end portion of the tubular member to be necked-in adjacent the upper end of the mandrel. The lower end of the tubular member rests in a recess 27 in the base 28 of the apparatus. The punch press is then actuated so that the press ram 20 moves downwardly along the longitudinal axis of the mandrel 9 and tubular member. During this downward movement the knockout plug 12 moves into the upper end of the tubular member to a position adjacent the dome-shaped surface 10 of the mandrel 9 where its motion is arrested. The abutment member 24 is adjusted and the thickness of the spacer shim 28 is selected so that the lower end of the knockout plug 12 contacts or is very close to the dome-shaped surface 10 in this working position. The juncture of the lower end surface of the knockout plug 12 and the outer cylindrical surface thereof is honed to a relatively small radius, 0.002–0.003 inch, so there may be close contact of the plug 12 with the mandrel 9 in the working position to ensure that the upper portion of the tubular member is fed into the space between the knockout plug 12 and the die insert 16 of the outside tool 14 as the press ram 20 continues its descent. Necking-in of the tubular member is effected by this continued downward movement of the outside tool 14 and press ram 14 after the knockout plug 12 has contacted the mandrel 9. The extent of downward movement of the outside tool is adjusted by means of the press setting to control the tolerance between the die insert 16 and the mandrel 9 in accordance with the thickness of the sheet material of the tubular member. During the upward movement of the press ram the outside tool 14 first moves upwardly with respect to the stationary mandrel 9 while the knockout plug 12 remains biased against the mandrel by the spring 23 until the press ram contacts the knockout bar 22.

Figure 2:
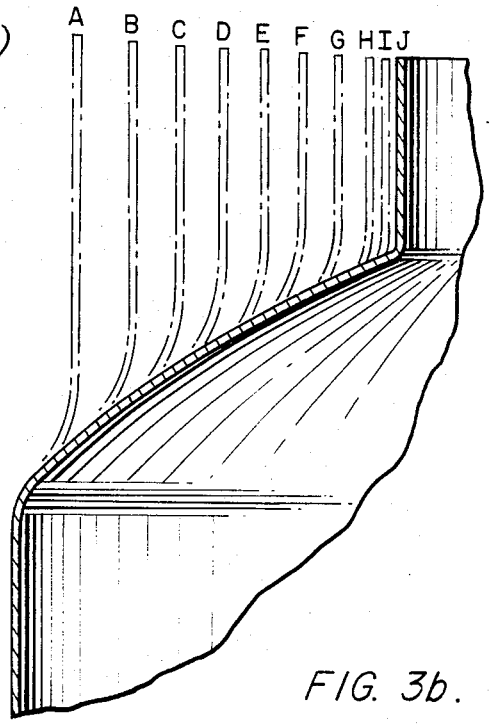
Figure 5:
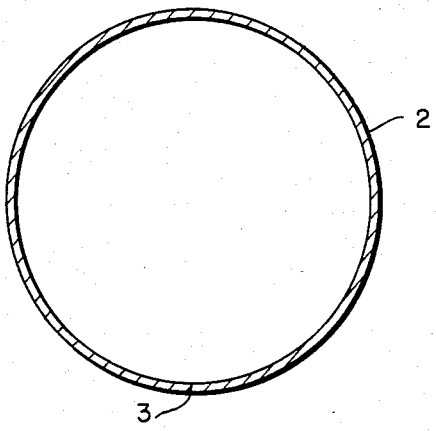
FIG. 5 is a cross sectional view of the container of FIG. 1 taken along the line V—V.

In the embodiment of the invention illustrated in FIG. 2, a tubular member having an initial diameter of 2.080 inches and a wall thickness of 0.0083 inch is progressively necked-in over a series of 10 necking steps to a diameter of 1.027 inches. That is, a 50.6% reduction in the diameter of the tubular member is effected by reducing the diameter approximately 7 to 8% during the initial necking steps and approximately 3 to 4% in the final two steps. The diameter of the necked-in portion, the radius of curvature between the dome-shaped surface and the cylindrical necked-in portion and the cumulative diameter reduction with each necking step are illustrated in Table A.

TABLE A

| Necking Step | Diameter Necked-In End | Radius of Curvature | Cumulative Diameter Reduction |
|---|---|---|---|
| A | 1.914 | .250 | .166 |

TABLE A-continued

| Necking Step | Diameter Necked-In End | Radius of Curvature | Cumulative Diameter Reduction |
|---|---|---|---|
| B | 1.761 | .213 | .319 |
| C | 1.629 | .181 | .451 |
| D | 1.507 | .154 | .573 |
| E | 1.394 | .131 | .686 |
| F | 1.289 | .111 | .791 |
| G | 1.192 | .094 | .888 |
| H | 1.103 | .080 | .977 |
| I | 1.059 | .030 | 1.021 |
| J | 1.027 | .030 | 1.053 |

Thus, the method of making a necked-in tubular member according to the invention comprises the steps of forming a sheet material into a generally cylindrical tubular member and butt welding the adjacent longitudinally extending edges of the sheet, arranging the welded tubular member about a mandrel having a free end portion with a dome-shaped surface, reducing the diameter of a free end portion of the tubular member and forming an intermediate portion between the reduced diameter free end portion and the remainder of the tubular member which extends along a portion of the dome-shaped surface of the mandrel, and further reducing the diameter of the free end portion of the tubular member and increasing the extent of the intermediate portion along the dome-shaped surface of the mandrel. The step of further reducing the diameter of the free end portion of the tubular member and increasing the step of the intermediate portion along the dome-shaped surface of the mandrel is repeated until the diameter of the free end is at least approximately 15% less than the initial diameter. In the illustrated example, the welded tubular member is necked-in to a diameter on the order of one-half of the original tube diameter. In another case, a tubular member having an initial diameter of 1 12/16ths inch can be necked-in to approximately 1 inch to accept a standard aerosol valve assembly. The reduction in this last mentioned example is approximately 40%.

The reduced free end portion of the tubular member is then trimmed to obtain a smooth working surface as illustrated in FIG. **4*b*. The trimmed end is thereafter curved to form a standard size aerosol can opening upon which a conventional aerosol valve assembly can be mounted. The free end may be curled outside in a conventional way or, as illustrated in FIG. 4*d*, it may be curled inside with the trimmed edge tucked inside the curl to protect the raw edge created by trimming from aggressive products, if any, that the container might hold. As a preliminary step in the curling operation, a rotary operating tool is used to bead the neck inwardly at 29 to prepare and determine the flow direction of the material in the curling step. The beaded neck is then rolled inwardly and collapsed by way of a rotating curling tool or a punch like curling tool to form a standard size aerosol can opening as illustrated in FIG. 4*d***.

While I have shown and described several embodiments in accordance with the invention, it is understood that the same is not limited thereto but is susceptible of numerous changes and modifications as would be known to those skilled in the art, given the present disclosure. For example, the upper portion of the necked container need not be curled but could be threaded, for example, to receive a threaded container closure. Further, the sheet material of the butt welded tubular member need not be steel but could be another metal such as aluminum or even a non-metallic material. Also, while the dome-shaped configuration of the necked tubular member is a smooth curvilinear surface in the illustrated embodiment, this dome-shaped configuration could have other forms such as conical, etc. I therefore do not wish to be limited to the details shown and described herein but intend to cover all such changes and modifications as are encompassed by the scope of the appended claims.

We claim:

1. A method of making a necked tubular member comprising the steps of forming a sheet of material into a generally cylindrical tubular member and welding the adjacent longitudinally extending edges of the sheet, arranging said welded tubular member about a mandrel having a free end portion with a dome-shaped surface, performing a plurality of necking-in operations on said welded tubular member while said member is arranged about said mandrel to progressively reduce the diameter of a free end portion of the tubular member at least 15% from the original diameter of said tubular member with the necked-in end of the tubular member having a dome-shaped configuration, said plurality of necking-in operations including a first necking-in operation of reducing the diameter of the free end portion of the tubular member and forming an intermediate portion between said reduced diameter free end portion and the remainder of the tubular member over a portion of said dome-shaped surface of said mandrel and a further necking-in operation of further reducing the diameter of the free end portion of the tubular member and further forming said intermediate portion over said dome-shaped surface of said mandrel to increase the extent of said intermediate portion.

2. A method according to claim 1, wherein the diameter of said free end portion is reduced on the order of one-half of the original diameter of said tubular member by said plurality of necking-in operations.

3. A method according to claim 1, wherein said sheet of material is steel.

4. A method according to claim 1, including the additional step of trimming the reduced free end portion of said tubular member and curling it.

5. A method according to claim 4, wherein the free end portion of said tubular member is curled by first beading the free end portion inwardly and then curling it inwardly on itself so that the trimmed edge thereof is tucked inside the curl.

6. A method according to claim 1, wherein the diameter of the free end portion of said tubular member is reduced approximately 8% in said first necking-in operation and approximately 3% in said further necking-in operation.

7. A method of necking-in a tubular member comprising the steps of providing a tubular member about a mandrel having a free end portion with a dome-shaped surface, performing a plurality of necking-in operations on said tubular member while said member is arranged about said mandrel to progressively reduce the diameter of a free end portion of the tubular member at least 15% from the original diameter of said tubular member with the necked-in end of the tubular member having a dome-shaped configuration, said plurality of necking-in operations including a first necking-in operation of reducing the diameter of the free end portion of the tubular member and forming an intermediate portion between said reduced diameter free end portion and the remainder of the tubular member over a portion of said dome-shaped surface of said mandrel and a further necking-in operation of further reducing the diameter of the free end portion of the tubular member and further forming said intermediate portion over said dome-shaped surface of said mandrel to increase the extend of said intermediate portion.

8. A method according to claim 7, wherein said further necking-in operation is repeated until the diameter of the free end is on the order of one-half of the original diameter of said tubular member.

9. A method according to claim 7, including the additional step of trimming the reduced free end portion of said tubular member and curling it.

10. A method according to claim 9, wherein the free end portion of said tubular member is curled by first beading the free end portion inwardly and then curling it inwardly on itself so that the trimmed edge thereof is tucked inside the curl.

11. A method according to claim 7, wherein said tubular member is a welded steel tubular member.

12. A method according to claim 11, wherein the diameter of the free end portion of said tubular member is reduced approximately 8% in said first necking-in operation and approximately 3% in said further necking-in operation.

13. A method according to claim 1, including the step of providing a plurality of pairs of cooperating inside and outside tools, respective pairs of said tools being used in cooperation with said mandrel to effect said plurality of necking-in operation.

14. A method according to claim 7, including the step of providing a plurality of pairs of cooperating inside and outside tools, respective pairs of said tools being used in cooperation with said mandrel to effect said plurality of necking-in operations.

* * * * *